United States Patent [19]

Keely

[11] 4,242,994

[45] Jan. 6, 1981

[54] IDLE SPEED CONTROL SYSTEM FOR VEHICLE ENGINES

[75] Inventor: William A. Keely, Fremont, Mich.

[73] Assignee: The Bendix Corporation, Southfield, Mich.

[21] Appl. No.: 857,636

[22] Filed: Dec. 5, 1977

[51] Int. Cl.[3] ..... F02M 7/00; F02B 33/00

[52] U.S. Cl. ..... 123/339; 123/353

[58] Field of Search ..... 123/119 D, 119 DB, 102

[56] References Cited

U.S. PATENT DOCUMENTS

| | | | |
|---|---|---|---|
| 3,661,131 | 5/1972 | Croft | 123/102 |
| 3,963,009 | 6/1976 | Mennesson | 123/119 D |
| 3,964,457 | 6/1976 | Coscia | 123/102 |
| 3,998,191 | 12/1976 | Beyerlein | 123/102 |
| 4,091,777 | 5/1978 | Monpetit | 123/102 |

*Primary Examiner*—Ronald B. Cox

*Attorney, Agent, or Firm*—Markell Seitzman; Gaylord P. Haas, Jr.; Russel C. Wells

[57] ABSTRACT

An idling speed control system for automotive vehicle engines is disclosed. A throttle valve bypass passage for intake air is provided with an air control valve of the on-off type. The air control valve is electrically energized by a pulse train of substantially constant pulse repetition rate and pulse duration modulation so that the duty cycle of the valve is varied according to deviation of the engine idling speed from a set point value. The pulse repetition rate of the energizing pulses is higher than the frequency at which the engine can respond to air supply pulsations in the intake manifold.

3 Claims, 3 Drawing Figures

IDLE SPEED CONTROL SYSTEM FOR VEHICLE ENGINES

FIELD OF THE INVENTION

This invention relates to control systems for automotive vehicle engines; more particularly, it relates to an idle speed control system for engines having fuel injection systems.

BACKGROUND OF THE INVENTION

In an automotive engine, the idling speed tends to vary over a substantial range depending upon ambient conditions and engine load conditions, especially in an engine provided with fuel injection. When the engine throttle is in the idling position the induction passage from the air cleaner to the intake manifold is throttled to a fixed opening. Accordingly, a change in engine load or ambient conditions which tend to reduce engine speed also have the effect of producing an excessively rich air/fuel mixture. A change in engine load or ambient conditions which tends to increase engine idling speed results in an excessively lean air/fuel mixture. It is desirable to automatically change the flow of intake air in response to such engine load or ambient condition changes so that the engine speed can remain substantially constant. It is an objective of this invention to provide a control system for maintaining engine idling speed substantially constant despite variations in engine load conditions and certain ambient operating conditions.

THE PRIOR ART

It is known in the prior art to control engine idling speed by changing the flow of air supplied to the intake manifold. Such an arrangement is disclosed in the Croft U.S. Pat. No. 3,661,131 which provides a throttle bypass passage in an engine having a fuel injection system. In the system disclosed in the Croft patent an air regulating valve of the vacuum actuated type is disposed in the bypass passage. The amount of opening of the air valve, and hence the amount of bypass air, is continuously variable according to the vacuum produced in the diaphragm chamber of the valve actuator. The vacuum in the valve actuator is regulated by the switching of a solenoid valve open or closed according to whether the engine speed is above or below a set idling speed. The Croft patent also discloses a motor driven valve in place of the solenoid valve for regulating the vacuum in the vacuum actuated air regulating valve. This system is disadvantageous in that it requires both an air regulating valve of the vacuum actuated type and a vacuum regulator valve for controlling the bypass air regulating valve. As an alternative the Croft patent discloses a system which omits the vacuum actuated valve and uses only a motor driven bypass air regulating valve which directly controls the bypass air by a continuously variable orifice in the bypass passage. This sytem is disadvantageous in the requirement for a motor driven regulating valve of the proportional or continuously variable orifice type and the special control circuit required thereby.

In engine speed control systems, it is known in the prior art to control the throttle valve position by a vacuum actuator which is controlled by an on-off type of vacuum regulator valve. Such an arrangement is shown in the Fales U.S. Pat. No. 3,070,185. In the system of this patent, the vacuum regulator valve is energized and deenergized with a variable duty cycle; the duty cycle is increased or decreased according to whether the engine speed is below or above a set value of engine speed. A disadvantage of this speed control system, if it were to be adapted for engine idling speed, is that it requires a vacuum regulator valve and a vacuum actuator for the throttle valve and hence is expensive and complicated.

SUMMARY OF THE INVENTION

According to this invention, an improved engine idling speed control system is provided which permits closed loop control of idling speed by means of a single valve which is disposed in a throttle bypass passage. This is accomplished by an electrically energized on-off air control valve for alternately opening and closing the bypass passage and pulse generating means for energizing an deenergizing the valve at a substantially constant repetition rate. A speed sensing means is connected with the pulse generating means to establish a predetermined pulse duration at a set idling speed to operate the valve at a predetermined duty cycle at the set value of idling speed and for increasing or decreasing the duty cycle when the engine speed deviates below or above the set idling speed whereby the engine speed is regulated to maintain the set idling speed. Additionally, according to the invention, the predetermined repetition rate is established at a value greater than the frequency at which the engine can respond and thus the engine speed does not exhibit hunting or oscillation.

Further, according to the invention, the speed sensing means comprises a tachometer circuit for generating an electrical speed signal and the pulse generating means comprises comparator means with a ramp generator producing a recurrent ramp signal. The speed signal and the ramp signal are applied to the comparator means to produce a train of pulses having variable pulse duration according to the engine speed deviation from the set idle speed. The pulse train energizes the air control valve at a variable duty cycle to maintain the engine idling speed at the set value.

DETAILED DESCRIPTION

A more complete understanding of this invention may be obtained from the detailed description that follows taken with the accompanying drawings in which.

Figure 1:
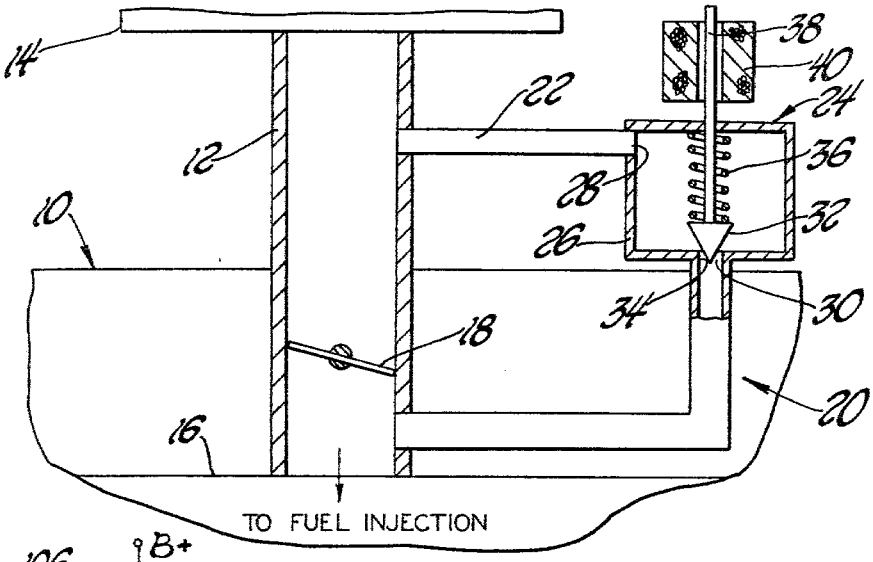
FIG. 1 is a diagrammatic representation of the air induction system of an engine including the inventive throttle bypass control system.

Referring now to the drawings, there is shown an illustrative embodiment of the invention for use in an automotive vehicle having a conventional internal comustion engine provided with fuel injection.

As shown in FIG. 1, an engine 10 comprises an induction passage 12 having its upper end in communication with the atmosphere through an air cleaner 14. The lower end of the induction passage 12 is connected with an intake manifold 16 which in turn in provided with a conventional fuel injection system (not shown). The induction passage 12 is provided with a throttle valve 18 for controlling the air supply to the intake manifold 16. When the engine throttle valve 18 is in the idle position, as indicated, the induction passage 12 is reduced to a small opening for the passage of intake air to the intake manifold.

In accordance with this invention, an auxiliary air supply means 20 is provided to supply atmospheric air to the intake manifold. The auxiliary supply means comprises a bypass passage 22 which communicates with the induction passage 12 at a location upstream of the throttle valve 18. The bypass passage 22 extends through an air control valve 24 into communication with the intake manifold 16 by connection with the passage 12 at a location downstream of the throttle valve 18.

The air control valve 24 is an electrically controlled on-off valve (i.e. a two-position valve which is either open or closed). The valve 24 comprises a valve body 26 having an inlet 28 and an outlet 30. A valve element 32 is normally closed against a valve seat 34 under the influence of a bias spring 36. The valve element 32 is supported by a stem or armature 38 which is mounted for reciprocation in the valve body 26. An electromagnet or solenoid winding 40 is mounted on the valve body and the armature 38 extends coaxially therethrough. When the solenoid winding 40 is electrically energized, the armature 38 is retracted toward the winding against the resistance of the bias spring 36 and the valve element 32 is lifted from the valve seat 34 to a fully open position. When the winding 40 is deenergized, the armature 38 is extended away from the winding by the force of the coil spring 36 and the valve element 32 engages the valve seat 34 to fully close the valve.

The air control valve 24 is adapted to be alternately energized and deenergized at a cyclical rate in the range of 40 to 100 Hz. The frequency of operation is selected to be at a value which is higher than that at which the engine 10 can respond to pulsations of air supply in the intake manifold. The valve 24, as will be described below, is energized at a variable duty cycle in accordance with control conditions. The duty cycle is the ratio of valve on-time (valve open) to the sum of on-time plus off-time (valve open) times 100%. Accordingly, the time average value of air flow through the valve is proportional to the root mean square value of the duty cycle times the flow capacity through the valve when it is fully open.

Figure 2:
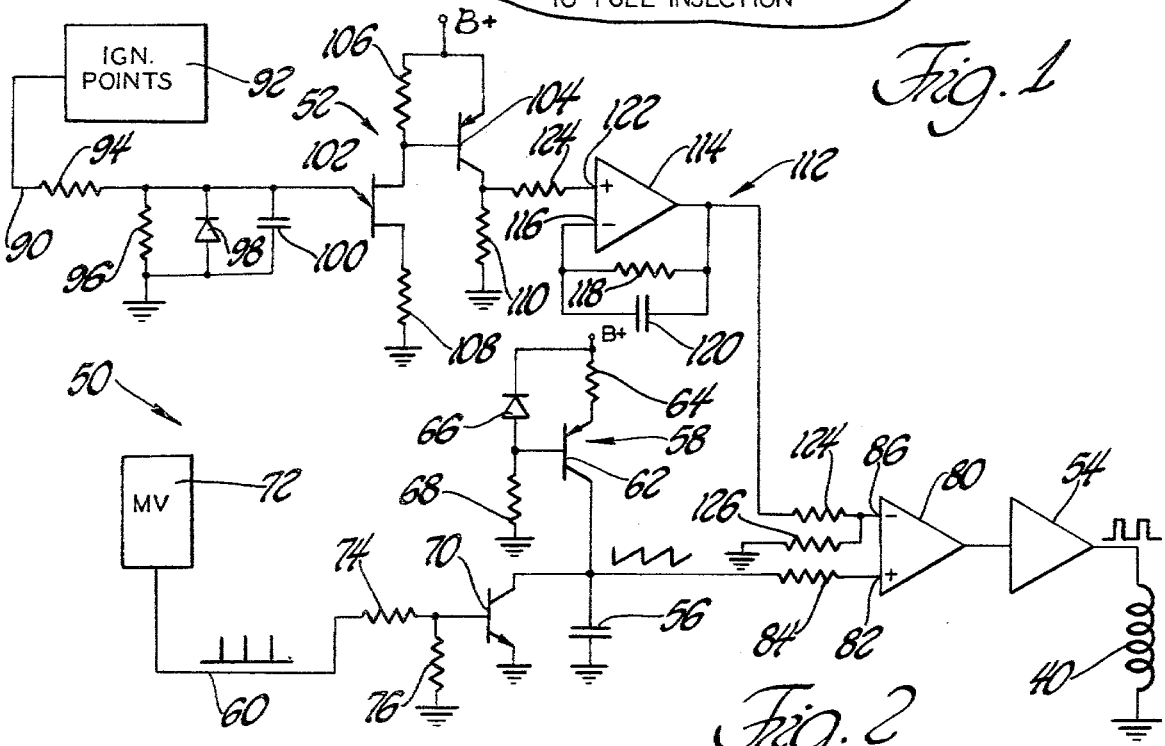
FIG. 2 is a schematic diagram of an electronic circuit for use in this invention.

In order to actuate the air control valve 24 for the purpose of controlling the idling speed of the engine, the control circuit of FIG. 2 is provided. In general, the control circuit comprises a pulse generating means 50 which is adapted to produce a train of pulses P at a substantially constant pulse repetition rate. A speed sensing or tachometer circuit 52 is connected with the pulse generating means and is adapted to control the pulse width in the train of pulses from the pulse generating means 50. The output of the pulse generating means is applied to the valve solenoid winding 40. Accordingly, the valve solenoid winding is energized at a substantially constant pulse repetition rate with the pulse train being pulse width modulated according to the value of the engine speed signal.

The pulse generating means 50 comprises a ramp generator which includes a storage capacitor 56 connected across a charging circuit 58 and also connected across a discharging circuit 60. The charging circuit 58 comprises a constant current source including a transistor 62. The emitter of the transistor is connected with the power supply voltage through a resistor 64 and the collector is connected to the upper terminal of the capacitor 56. The base of the transistor is connected with the junction of a Zener diode 66 and a resistor 68 which are serially connected across the power supply voltage to form a voltage divider. The charging circuit 58 is adapted to supply a constant current to the storage capacitor 56 to produce a voltage thereon which increases linearly with time. The discharging circuit 60 comprises a switching transistor 70 which is turned on and off at a substantially constant frequency by an astable multivibrator 72. For this purpose, the output of the multivibrator 72 is connected to the base of the transistor 70 through a pair of voltage divider resistors 74 and 76. The collector of the transistor 70 is connected with the upper terminal of the storage capacitor 56 and the emitter of the transistor is connected directly to ground. The multivibrator 72, for example, has a pulse repetition rate of 10 pulses per second. Each pulse turns on the switching transistor 70 and holds it on long enough to discharge the storage capacitor 56 to substantially ground potential. For this purpose, the pulses produced by the multivibrator 72 may have a pulse duration of several hundred microseconds. The time interval between pulses will be, in the example stated, approximately 100 milliseconds. The storage capacitor 56 will be discharged in the short time interval when transistor 70 is on and it will be charged in a linear fashion over a relatively long period when the transistor 70 is off to produce a linear ramp voltage which is repeated at the pulse repetition rate of the multivibrator 72. Accordingly, the output voltage from the ramp generator is a ramp voltage R of sawtooth waveform.

The pulse generator 50 also comprises a pulse width modulator which takes the form of a comparator 80. The comparator 80 is preferably a current input operational amplifier, such as a Norton opamp, and has its noninverting input 82 connected with the output of the ramp generator through a resistor 84. The inverting input 86 of the comparator is connected with the output of the tachometer circuit 52, which will be described presently.

The tachometer circuit 52 is adapted to produce a speed signal S in the form of a DC voltage having a magnitude which is proportional to the speed of the engine. The tachometer 52 is an ignition pulse responsive tachometer circuit of a well known type. The input 90 of the tachometer circuit is connected across the breaker points 92 of the ignition circuit of the engine. A train of ignition pulses at the input 90 is applied to a filter including resistors 94 and 96, a diode 98 and a filter capacitor 100 to eliminate the negative and the high frequency component. The output of the filter is applied to the input of a pulse forming circuit or generator which includes a field effect transistor 102 and a bipolar transistor 104. The filtered ignition pulses are applied to the gate of the field effect transistor 102 which has its source electrode connected with the supply voltage source through a resistor 106 and its drain electrode connected to ground through a resistor 108. Thus the transistor 102 becomes conductive on the occurrence of each ignition pulse. The transistor 104 has its emitter connected with the power supply voltage and its collector connected to ground through a resistor 110. The base of transistor 104 is connected to the source electrode of transistor 102. Accordingly, transistor 104 is turned on by each ignition pulse and produces a train of pulses at the output of the pulse generator across resistor 110. The output of the pulse generator is applied to the input of an integrator 112 which comprises an operational amplifier 114, such as a Norton opamp, having its output connected through a feedback circuit to the inverting input 116 through a resistor 118 and a parallel capacitor 120. The noninverting input 122 of the operational amplifier 114 is connected with the output of the pulse generator through a resistor 124. The output of the integrator 112 is the aforementioned speed signal S, i.e., a DC voltage having a magnitude proportional to the speed of the engine. The speed signal S is applied to the inverting input 86 of the comparator 80 through a voltage divider including a resistor 124 and a variable resistor 126.

The comparator 80 is provided for the purpose of producing pulses of constant pulse repetition rate and variable duration; hence it functions as a pulse width modulating means. The output of the comparator 80 is applied to the input of a power switching amplifier 54 which merely power amplifies the pulse output of the comparator. The comparator 80 is adapted, in a conventional manner, to produce a low or zero output voltage when the voltage applied to the noninverting input 82 is less than the voltage applied to the inverting input 86; when the voltage applied to the noninverting input exceeds the voltage applied to the inverting input the comparator produces a high or positive output voltage. Assuming, for explanatory purposes, that the speed signal voltage is zero; the ramp voltage, being greater than zero throughout substantially each cycle, would cause the comparator to produce a positive output voltage throughout each ramp cycle. If, on the other hand, the speed signal voltage is greater than the peak value of the ramp voltage, the comparator would produce a zero output voltage. Since the circuit is to be operative only in the idling speed range, the ramp generator is adapted to produce a peak voltage value approximately equal to the value of the speed signal voltage which corresponds to the upper limit of the idling speed range of the engine. To provide for output pulses from the comparator 80 which have a pulse duration of predetermined value which can be increased or decreased, the tachometer generator 52 is calibrated so that the magnitude of the speed signal voltage, at the desired set value of engine idling speed, is equal to approximately one-half peak value of the ramp voltage. This is suitably accomplished, for example, by adjustment of the variable resistor 126. Consequently, when the engine is operating at the set value of engine idling speed the comparator 80 produces a square wave output pulse train in which the pulse duration is equal to one-half of the period of each cycle. In other words, in this operating condition, the pulse generating means 50 is operated with a duty cycle of 50% as represented by the output pulse train from the comparator 80. It will be appreciated that an increase in the speed signal voltage indicating deviation of the engine speed above the set idling speed causes the pulse generating means 50 to produce an output pulse train having pulses of shorter duration. The pulse generating means may be operated at the duty cycle ranging from the 50% value downwardly to substantially 0%. On the other hand, when the speed signal voltage decreases indicating deviation of the engine speed downwardly from the set idling speed, the pulse duration increases. Thus, the pulse generating means 50 may be operated with the duty cycle ranging from the 50% value upwardly to substantially 100%.

The output pulse train of the pulse generating means from the amplifier 54 is applied to the solenoid winding 40 of the air control valve 24. The valve is operated in an on-off manner, i.e., it is fully opened during each pulse in the pulse train of the amplifier 54 and it is fully closed between the pulses. As a result the air flow through the valve is proportional to the root mean square value of the duty cycle times the flow capacity through the valve in the open condition.

Figure 3:
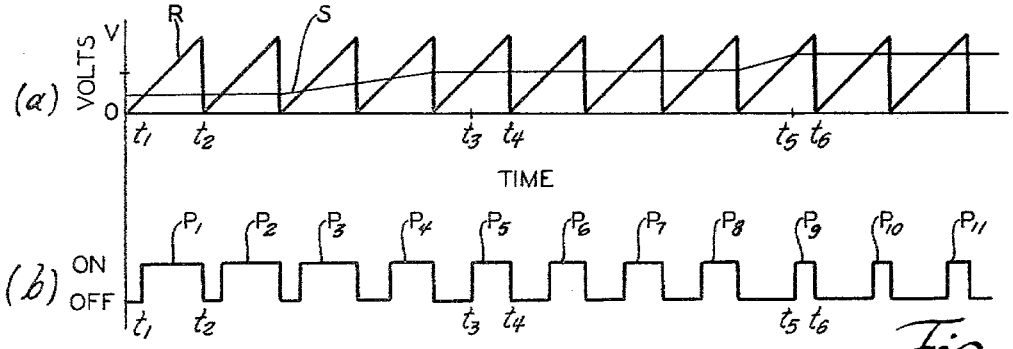
FIG. 3 is a graphical representation of the operation of the inventive control system.

The operation of the inventive idling speed control system will be summarized with reference to FIG. 3. The ramp generator produces a ramp voltage having a wave form R as depicted in FIG. 3(*a*). The ramp voltage is of saw-tooth waveshape and is of substantially constant frequency. It has a peak value as indicated in FIG. 3(*a*). The tachometer generator 52 generates a variable speed voltage having a magnitude S, as indicated in FIG. 3(*a*), which is proportional to engine speed. At the desired set value of engine idling speed the speed voltage has a set voltage value of V/2. FIG. 3(*b*) shows the pulse energization of the valve 24 by the power switching amplifier 54 for varying values of engine speed. When engine operating conditions cause a low idling speed, the speed voltage S is less than the set voltage V/2 as indicated in the first few cycles depicted in FIG. 3(*a*). Accordingly, the comparator 80 is switched on at $t_1$ and it is switched off at $t_2$. In this condition, as depicted in FIG. 3(*b*), the pulse generator 50 is operated with a duty cycle greater than 50% and the valve 24 is operated at a duty cycle greater than the predetermined duty cycle. Accordingly, increased by-pass air is supplied to the engine intake manifold through the passage 22 and the valve 24 and the engine speed is increased. The energization of the valve, with the pulse generator having a duty cycle greater than 50%, is represented by the energizing pulses $P_1$, $P_2$, $P_3$ and $P_4$. The engine speed increases until it reaches the set value of idling speed at which the comparator 80 is switched on at $t_3$ and is switched off at time $t_4$ as shown in FIG. 3(*a*). While the speed voltage remains at the set value, the valve 24 is energized with the pulse generator operating at a 50% duty cycle, as represented by energizing pulses $P_5$ through $P_8$. When an engine disturbance results in overspeed, the speed voltage S increases above the set value; this results in the comparator 80 being switched on at time $t_5$ and being switched off at time $t_6$, as shown in FIG. 3(*a*). Consequently the valve is energized with the pulse generator operating at a duty cycle less than 50% as depicted by the energizing pulses $P_9$, $P_{10}$ and $P_{11}$. This causes the by-pass air through the passage 22 and the valve 24 to be reduced and the engine speed is reduced toward the set idling speed.

It is known that the typical automotive engine requires an engine idling speed which is substantially higher at low engine temperatures than the idling speed after the engine is warmed up. For example, when the coolant temperature is at −20° F. the desired idle speed for a given engine may be at 1200 RPM and at a coolant temperature of 100° F., the desired idling speed may be about 600 RPM. The control system, as described herein, may be provided with means for increasing the set value of idling speed during engine warm-up. This may be provided, for example, by a coolant temperature responsive resistance means connected with the output of the tachometer circuit 52, so that the speed voltage is programmed to increase as the engine warms up to its normal operating temperature.

Although the description of this invention has been given with respect to a particular embodiment, it is not to be construed in a limiting sense. Many variations and modifications will now occur to those skilled in the art. For a definition of the invention reference is made to the appended claims.

The embodiment of the present invention in which an exclusive property or privilege is claimed are defined as follows:

1. An idle speed control system for use with an internal combustion engine of the type including a primary air passage having throttle means located therein for controlling the amount of air flowing through the primary air passage into the internal combustion engine, an auxiliary air supply means, including a bypass passage, for supplying auxiliary air to the engine bypassing the valve means, an air control valve connected to control the auxiliary air supply means for controlling the amount of auxiliary air supplied to the engine, the idle speed control system comprising:

speed means for generating a signal indicative of engine speed;

duty cycle means connected to said valve including pulse generator means for generating a constant frequency electrical signal for controlling the amount of auxiliary air supplied and for maintaining the speed of the engine during idle conditions at a set value, said electrical signals having a fixed pulse width to operate said valve at a predetermined duty cycle at said set value of idle speed, said duty cycle means further including:

recurrent signal generating means for generating a repetitive signal having said substantially constant repetition rate; and pulse width generator means responsive to said repetitive signal and said speed signal for modulating said pulse width signal to operate said valve during the time the magnitude of said repetitive signal exceeds the magnitude of said speed signal, said pulse width generator means further including idle speed range means for prohibiting the communication of said pulse width signal to said valve during intervals when the engine speed exceeds that value of speed corresponding to the upper limit of engine idling speed and where said idle speed range means includes means for adjusting the peak value of said repetitive signal equal to the value of said speed signal when the engine speed is at the upper limit of engine idling speed.

2. In an internal combustion engine of the type including an intake manifold having an air induction passage communicating with the atmosphere, a throttle valve in the passage for controlling the air flow from the atmosphere to the intake manifold, fuel supply means communicating with the atmosphere, a throttle valve in the passage for controlling the air flow from the atmosphere to the intake manifold, fuel supply means communicating with the manifold, and idling speed control means including an auxiliary air supply means for providing auxiliary atmospheric air to the intake manifold, the improvement wherein the auxiliary air supply means comprises:

a bypass passage providing communication of said intake manifold with the atmosphere;

an electrical energized air control valve in said bypass passage for alternately opening and closing the bypass passage;

pulse generating means connected with the valve for generating a train of pulses to energize and deenergize the valve at a substantially constant pulse repetition rate, wherein said repetition rate is greater than the frequency at which the engine can respond to changes in the amount of intake air;

engine speed sensing means connected with said engine and said pulse generating means for establishing a predetermined pulse duration of said pulses at a set value of idling speed whereby said valve is operated at a predetermined duty cycle at the set value of idling speed wherein said speed sensing means comprises a tachometer circuit connected with said engine for generating an engine speed signal, said pulse generating means comprises comparator means and a ramp generator for generating a recurrent ramp signal, said comparator means having one input connected with said ramp generator for receiving the recurrent ramp signal and having its other input connected with said tachometer circuit for receiving said speed signal, said comparator producing an output pulse during the time interval said ramp signal exceeds said speed signal and wherein the peak value of said ramp signal is equal to the value of said speed signal when the engine speed is at the upper limit of engine idling speed range whereby the air control valve is closed when the engine speed is above the idling speed range; and said speed sensing means varying the duration of said pulses above and below the predetermined value as the speed deviates below and above respectively from the set idling speed whereby the valve duty cycle is varied from said predetermined duty cycle to regulate the engine speed at said set value of idling speed.

3. The apparatus as recited in claim 2 wherein said air control valve is an of-off valve.

* * * * *